US007963804B2

(12) United States Patent
Ma et al.

(10) Patent No.: US 7,963,804 B2
(45) Date of Patent: Jun. 21, 2011

(54) POWER STRIP

(75) Inventors: Xian-Wei Ma, Shenzhen (CN); Ting Luo, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/869,696

(22) Filed: Aug. 26, 2010

(65) Prior Publication Data

US 2011/0097941 A1 Apr. 28, 2011

(30) Foreign Application Priority Data

Oct. 23, 2009 (CN) ..... 2009 1 0308716

(51) Int. Cl.
*H01R 25/00* (2006.01)

(52) U.S. Cl. ..... 439/652; 439/214

(58) Field of Classification Search ..... 439/652, 439/654, 214, 174
See application file for complete search history.

(56) References Cited

U.S. PATENT DOCUMENTS

| | | | | |
|---|---|---|---|---|
| 7,556,511 | B1 * | 7/2009 | Hsu et al. | 439/119 |
| 7,874,856 | B1 * | 1/2011 | Schriefer et al. | 439/214 |
| 2003/0129869 | A1 * | 7/2003 | Milan | 439/214 |
| 2006/0234561 | A1 * | 10/2006 | Tanaka | 439/652 |
| 2009/0156061 | A1 * | 6/2009 | Bernstein | 439/652 |

* cited by examiner

*Primary Examiner* — Hien Vu
(74) *Attorney, Agent, or Firm* — Zhigang Ma

(57) ABSTRACT

A power strip includes a housing and prong fitting members arranged within the housing. The housing includes a first end including a plug and chambers each comprising two side plates and a bottom plate connecting the two side plates. The prong fitting members defines two/three openings electrically connected to the plug for receiving prongs of a two-prong plug or a three-prong plug. The prong fitting members are slidably connected to the two side plates of the housing.

7 Claims, 5 Drawing Sheets

POWER STRIP

BACKGROUND

1. Technical Field

The present disclosure relates to a power strip.

2. Description of the Related Art

A power strip usually includes a plurality of slot sets or outlets to receive contact prongs of plugs. The distance between each set of slots is constant. Certain plugs with larger sizes than conventional plugs may block adjacent outlets, causing it difficult for other plugs to insert into the adjacent outlets.

BRIEF DESCRIPTION OF THE DRAWINGS

The components of the drawings are not necessarily drawn to scale, the emphasis instead being placed upon clearly illustrating the principles of a power strip. Moreover, in the drawings, like reference numerals designate corresponding parts throughout several views.

DETAILED DESCRIPTION

Figure 1:
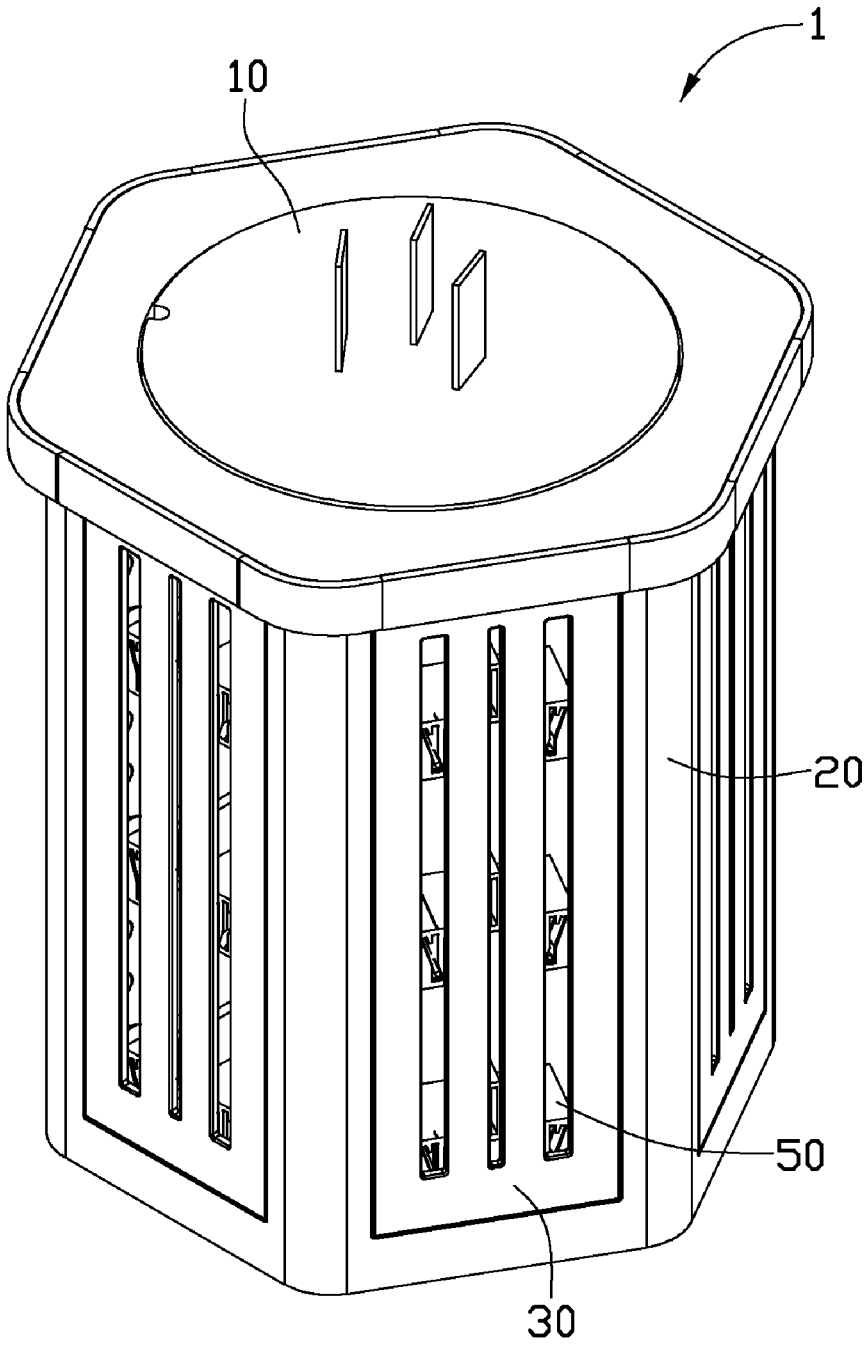
FIG. 1 is an isometric view of a power strip according to an exemplary embodiment.
Figure 2:
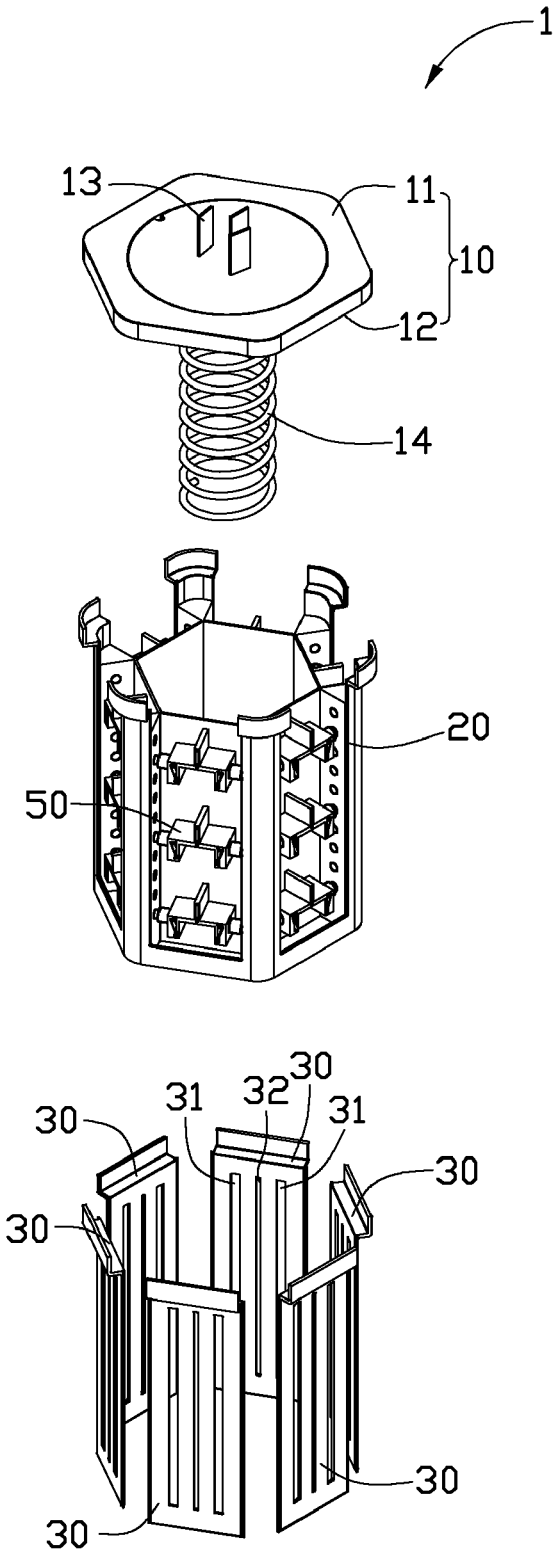
FIG. 2 is an exploded view of the power strip of FIG. 1.

Referring to FIGS. 1 and 2, a power strip 1 according to an exemplary embodiment is illustrated. The power strip 1 includes a housing 20, a cap 10 connected to the housing 20, and a number of prong fitting members 50 arranged within the housing 20.

The cap 10 includes a top surface 11 and a bottom surface 12 at opposite ends thereof. The cap 10 includes a plug 13 on the top surface 11 and a coiled cable 14 attached to the bottom surface 12 and connected with the plug 13.

Figure 3:
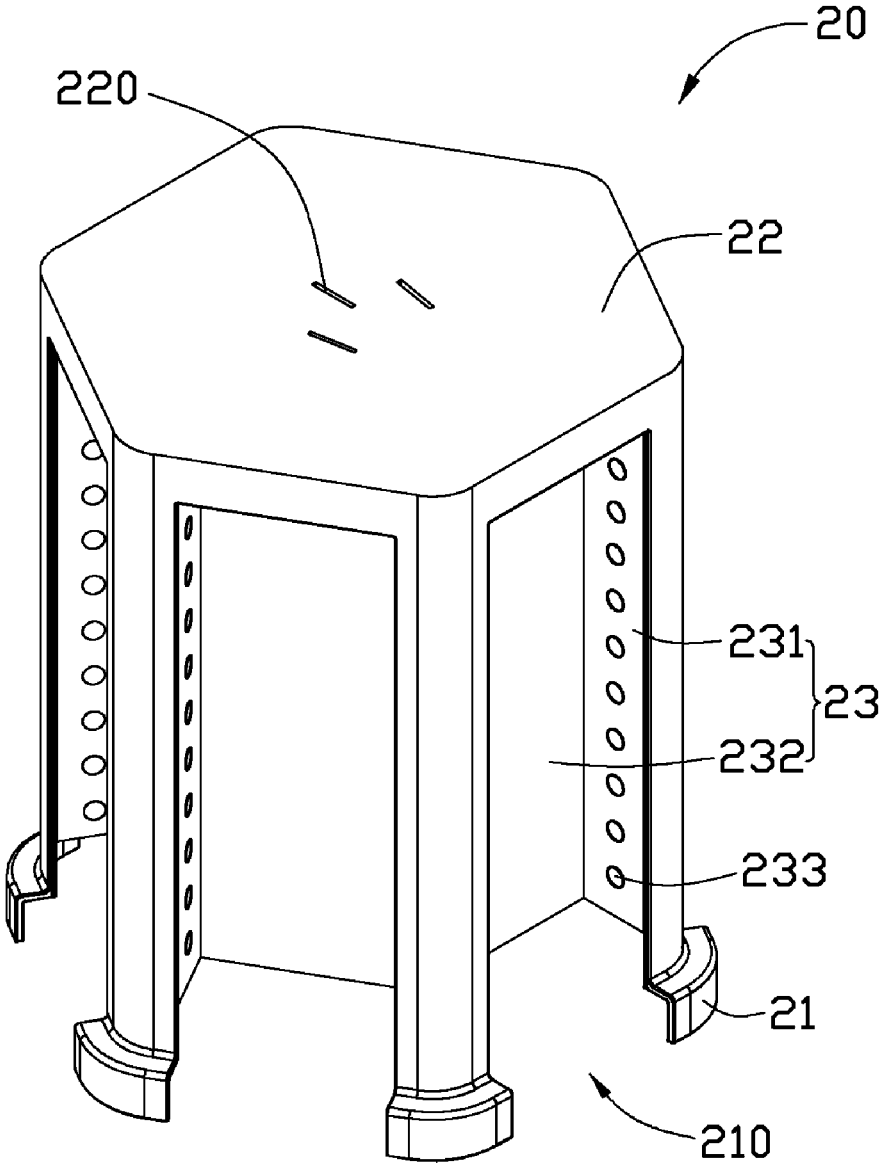
FIG. 3 is an isometric view of a housing of the power strip of FIG. 1.

Referring to FIG. 3, the housing 20 includes a first end 21 and an opposite second end 22. The first end 21 defines a receiving space 210 for receiving the cap 10. The second end 22 defines a socket 220 that is electrically connected to the plug 13 through the cable 14.

The housing 20 further defines a number of encircling chambers 23 within the housing 20 between the first end 21 and the second end 22. In the embodiment, the number of the chambers 23 is six. Each chamber 23 includes two opposite side plates 231 and a bottom plate 232 connecting the two side plates 231. The two side plates 231 correspondingly define a number of pairs of positioning holes 233.

Figure 4:
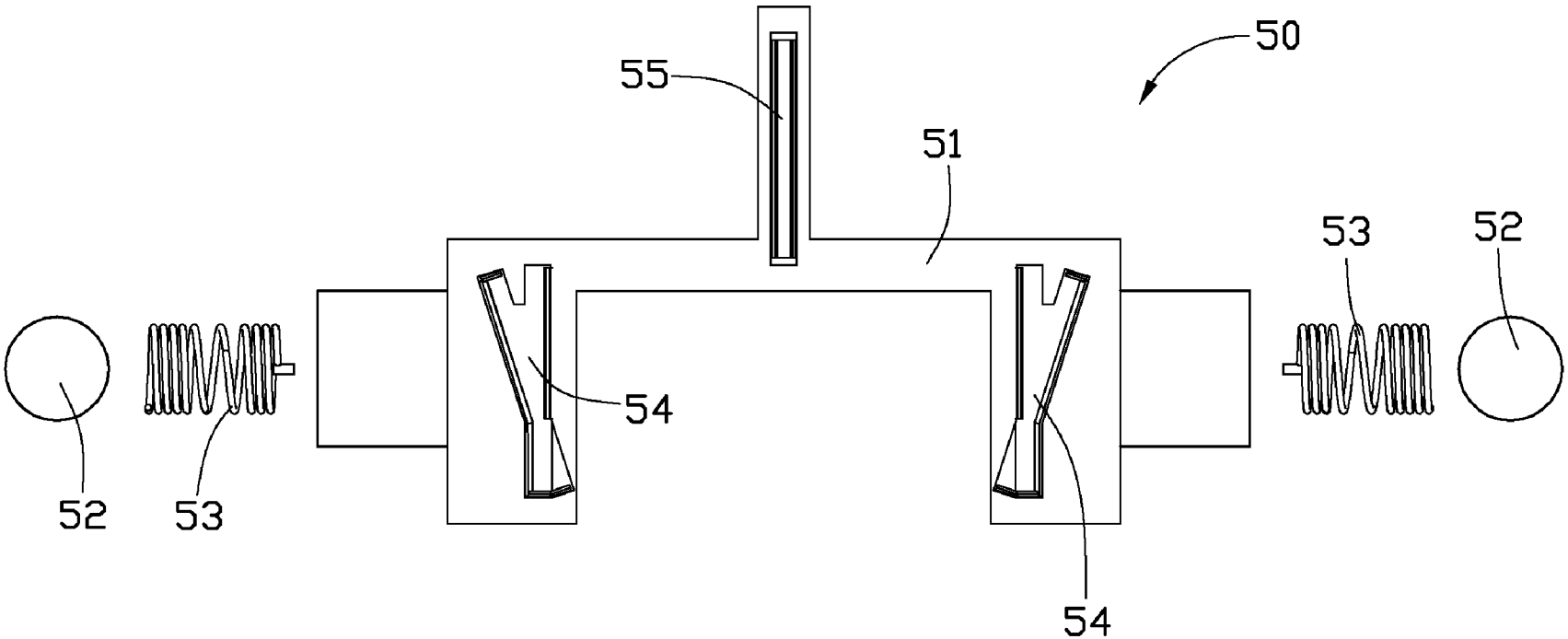
FIG. 4 is an exploded, schematic view of a prong fitting member of the power strip of FIG. 1.

Referring to FIG. 4, each prong fitting member 50 includes a main body 51, two poisoning blocks 52, and two resilient members 53. The two positioning blocks 52 are partially received in one pair of positioning holes 233 of the two side plates 231. In the embodiment, the resilient member 53 is a coil spring with two ends connected to the main body 51 and one positioning block 52. The two resilient members 53 can be compressed, and the position blocks 52 are capable of moving in or out of the pair of positioning holes 233 under influence of an external force. With this structure, the main body 51 is slidably fixed between the two side plates 231 (see FIG. 3).

In the embodiment, the main body 51 defines two opposing first openings 54 and a second opening 55 centrally located above the two first openings 54. When used, prongs of a two-prong plug 2 or a three-prong plug 3 can be inserted into the prong fitting member 50. When needed, the prong fitting members 50 can be moved to a proper position to provide sufficient space for larger plugs.

The power strip 20 further includes a number of cover plates 30 covering the chambers 23 of the housing 20. Each cover plate 30 defines two first slots 31 aligned with the first openings 54 and a second slot 32 aligned with the second opening 55 of the prong fitting members 50. Contact prongs of a plug can thus extend through the slots to be inserted into the openings of the prong fitting member 50.

Figure 5:
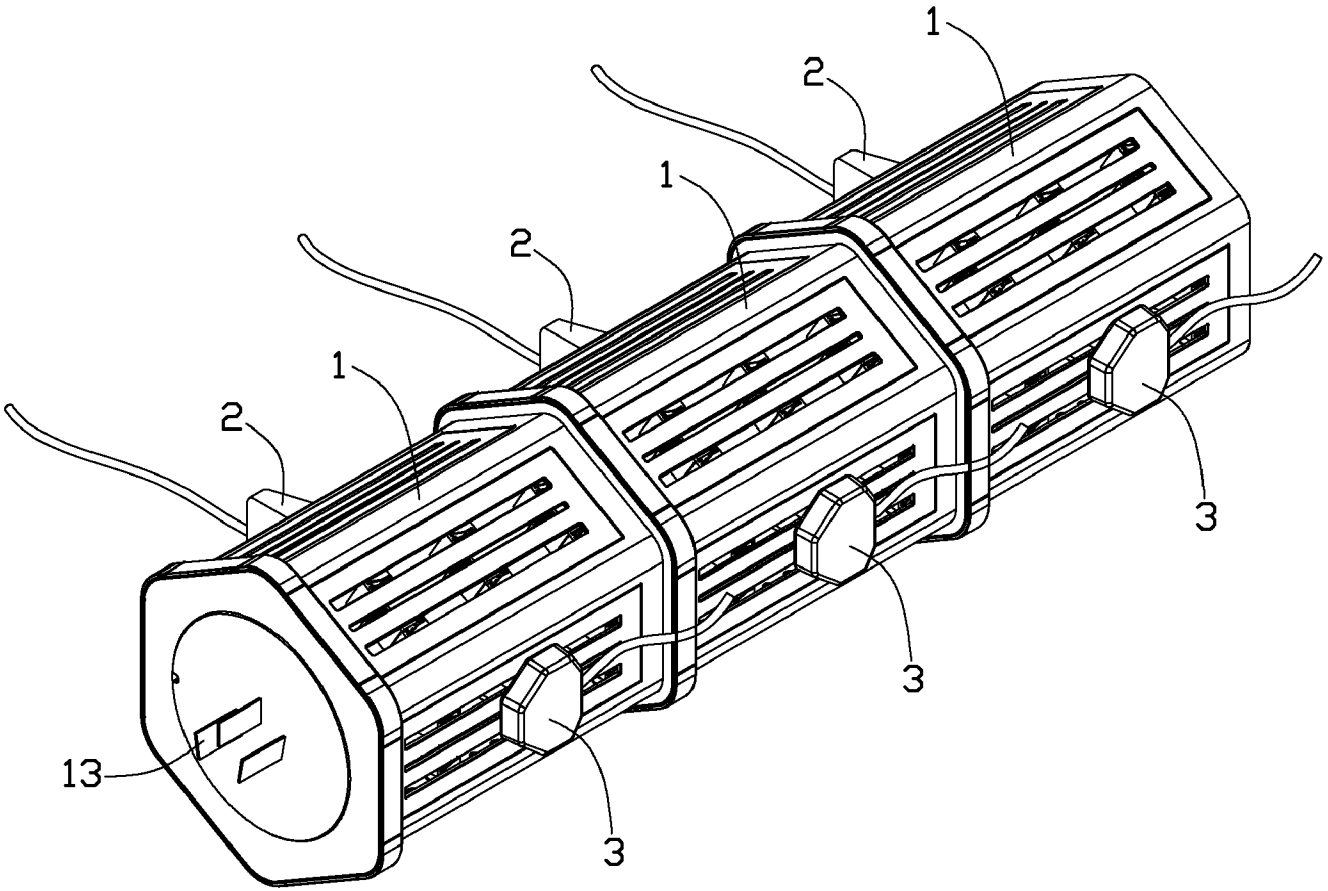
FIG. 5 is an isometric view of a number of power strips of FIG. 1 connected together.

Referring to FIG. 5, a number of power strips 1 can be connected together by inserting the plug 13 of one power strip 1 into the socket 220 of another power strip 1. A number of two-prong plugs 2 and three-prong plugs 3 can be plugged into the power strips 1.

Although the present disclosure has been specifically described on the basis of certain embodiments thereof, the disclosure is not to be construed as being limited to the described embodiments. Various changes or modifications may be made to the embodiments without departing from the scope and spirit of the disclosure.

What is claimed is:

1. A power strip comprising: a housing comprising:

a first end comprising a plug; and a plurality of chambers in each side of the housing, each of the chambers comprising two side plates and a bottom plate connecting the two side plates; and a plurality of prong fitting members slidably connected to the two side plates of one of the plurality of chambers and each of the prong fitting members defining two/three openings electrically connected to the plug for receiving prongs of a two-prong plug or a three-prong plug;

wherein each prong fitting member comprises a main body, two positioning blocks and two resilient members each disposed between the main body and one of the positioning blocks, the two side plates define a plurality of pairs of positioning holes for partially receiving the position blocks, the position blocks are capable of moving in or out of the pair of positioning holes under influence of an external force.

2. The power strip as described in claim 1, wherein the power strip further comprises a cap connected to the first end, the plug is fixed on the cap.

3. The power strip as described in claim 2, wherein the housing further comprises a second end opposite to the first end and defining a socket electrically connected to the plug.

4. The power strip as described in claim 3, wherein the cap comprises a top surface, a bottom surface, and a cable attached to the bottom surface, the socket is electrically connected to the plug through the cable.

5. The power strip as described in claim 1, wherein the resilient members are coil springs.

6. The power strip as described in claim 1, wherein the number of the plurality of chambers is six.

7. The power strip as described in claim 6, wherein the power strip further comprises six cover plates for covering the chambers, each of the six covers defines a plurality of slots aligning with the openings of a corresponding prong fitting member connected in the covered chamber.

* * * * *